United States Patent [19]

Iversen

[11] Patent Number: 4,479,502

[45] Date of Patent: Oct. 30, 1984

[54] COIN-HOLDER

[76] Inventor: Ronald K. Iversen, 830 Craigflower St., Victoria, B.C., Canada, V9A 2W8

[21] Appl. No.: 454,400

[22] Filed: Dec. 29, 1982

[51] Int. Cl.[3] ..... G07D 9/06

[52] U.S. Cl. ..... 133/1 A; D99/34; 133/1 R; 133/8 A; 133/8 R; 133/5 A; 211/60 R; 211/75

[58] Field of Search ..... 133/5 A, 5 R; 211/49 R, 211/60 R, 68, 74, 75

[56] References Cited

U.S. PATENT DOCUMENTS

D. 250,348 11/1978 Frangiosa et al. ..... D24/32

2,338,576 1/1944 Daugherty ..... 133/5 B 2,926,673 3/1960 Bernard ..... 133/8 R 3,678,650 7/1972 Green ..... 133/1 A X

*Primary Examiner*—Joseph J. Rolla

*Assistant Examiner*—Lawrence J. Miller

*Attorney, Agent, or Firm*—Jones, Tullar & Cooper

[57] ABSTRACT

A coin holding device for domestic use having several tubes each adapted to contain coins of a particular denomination and a stand for removably supporting the tubes in an upright position. The stand has a base with recesses adapted to support the tubes in the upright position and a groove associated with each recess to permit removal of each tube. Slots in an upper head member communicate with the tubes.

1 Claim, 3 Drawing Figures

COIN-HOLDER

BACKGROUND AND SUMMARY OF THE INVENTION

This invention relates to a coin holding device for domestic use.

The present invention provides a coin holding device of the above described type which is simple in construction, easy to use, inexpensive and which can provide at a glance a visual indication of its contents.

Broadly stated, the present invention is defined as a coin holding device comprising, in combination a plurality of clyindrical tubes adapted to contain coins of different denominations in an axially stacked relation; and a stand for removably supporting each of said tubes in an upright position.

BRIEF DESCRIPTION OF THE DRAWINGS

These and other features of the invention will become clear from the following description wherein reference is made to the appended drawings in which.

DESCRIPTION OF PREFERRED EMBODIMENT

Figure 3:
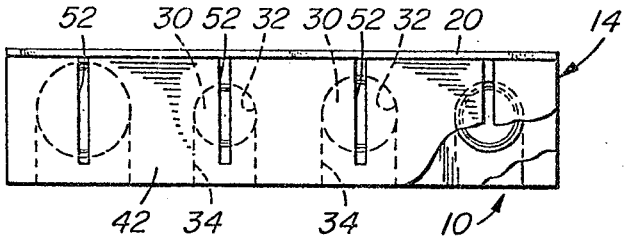
FIG. 3 is a top view of the holder of FIG. 1.

The coin holding device 10 of the present invention provides a plurality of cylindrical tubes 12 adapted to contain coins of different denominations in an axially stacked fashion and a stand 14 for supporting the tubes in an upright position. As will be explained later, the tubes are independently insertable in and removable from the stand.

The stand 14 has a base 16 upon which the lower or bottom ends 18 of the tubes rest. The base has means for maintaining the bottom ends of the tubes in position.

An upright panel or backing member 20 extends upwardly from the base and has means for holding the upper ends 22 of the tubes so as to prevent tipping of the tubes, particularly during the course of inserting coins into the tubes.

With these general features of the invention in mind, a preferred embodiment will now be described.

Figure 2:
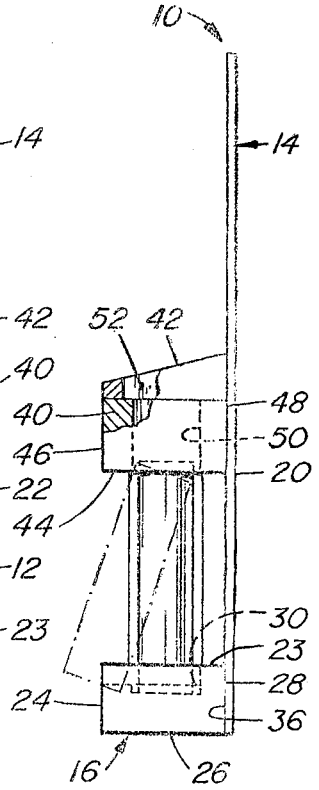
FIG. 2 is a side elevational view of the holder of FIG. 1.

The base 16 is an elongated member which is rectangular in both transverse and longitudinal section and includes a top surface 23, a front surface 24, a bottom surface 26 and a rear surface 28. The bottom surface 26 is adapted to sit on a supporting surface. The rear surface is secured by any suitable means to the upright panel member 20 adjacent the lower edge of the latter as illustrated in FIG. 2. However, it is to be understood that the stand may be made as a unitary unit if so desired.

The upper surface 23 is formed with a plurality of cylindrical recesses 30 each being sized to loosely receive the bottom end 18 of one of the tubes. The recesses 30 provide circumferential surfaces 32 which prevent accidental radial movement of the bottom ends of the tubes and therefore maintain the bottom ends of the tubes in position. Associated with each recess is a transverse groove 34 which extends from surface 32 to front surface 23 of the base. As will be explained later, grooves 34 facilitate removal and insertion of the tubes in the stand.

Figure 1:
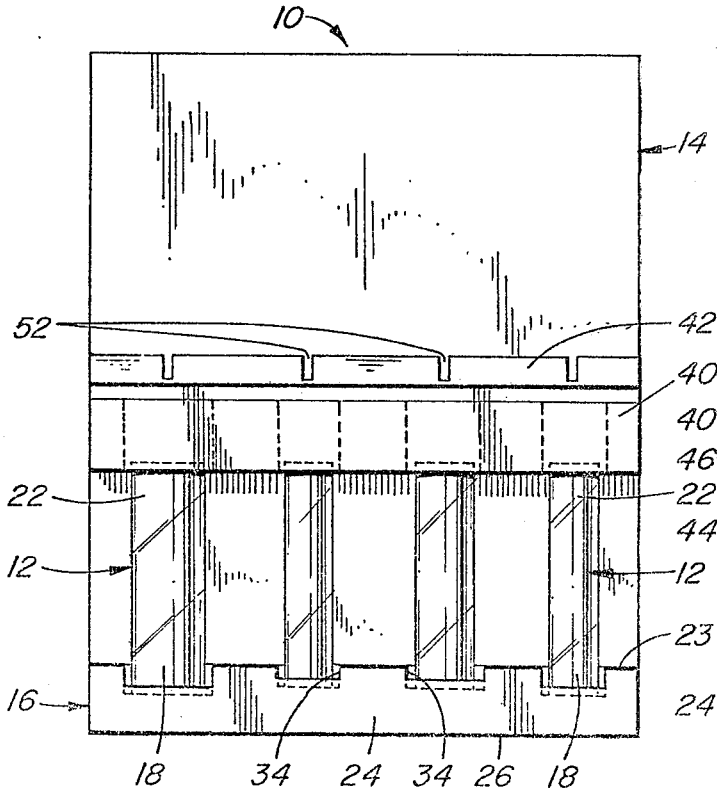
FIG. 1 is a front elevational view of the coin holder of the present invention.

Member 20 is in the form of an upright, generally rectangular panel, as best shown in FIG. 1, and has a width corresponding to the length of base 16. As explained earlier, the rear surface of the base is secured to member 20 along the lower edge 36 of the latter.

An elongated head member 40 extends forwardly from member 20. Member 40 is disposed parallel to base 16 and has an upper surface 42, a bottom surface 44, a front surface 46 and a rear surface 48.

Bottom surface 44 is provided with another series of cylindrical recesses 50, these being axially aligned with those of the base member and adapted to loosely telescopingly receive the upper ends 22 of the tubes 12, as shown in the drawings. Member 40 thus prevents undesired or accidental tipping of the tubes.

Coin feed aperture means in the form of slots 52 are provided in upper surface 42 and communicate with recesses 50.

The internal diameter of each tube corresponds substantially to the diameter of coin it is intended to hold. The diameter of each recess, in turn, corresponds substantially to the external diameter of the tubes. The tubes are preferably made of plastic and are transparent so as to provide a visual indication of their contents.

Member 20 may extend upwardly beyond member 40 so as to form a support for a photograph, a calender or advertising material.

In use, it will be apparent that coins which are to be stored are simply inserted into the slot above the tube containing coins of the proper denomination. When it is desired to empty a tube, its circumference is grasped, the tube moved upwardly, inwardly of recesses 50 until bottom end 18 clears the front portion of surface 32 of recess 30. Then the bottom end is moved forwardly into groove 34 until the upper end 22 exits recess 50. The reverse procedure is used when inserting a tube.

It will be appreciated that various modifications may be made without departing from the spirit of the invention as defined by the following claims.

The embodiments of the invention in which an exclusive property or privilege is claimed are defined as follows:

1. A coin holding device comprising, in combination:

a plurality of cylindrical, transparent tubes having different internal diameters for holding coins of different denominations in an axially stacked relation;

a stand for supporting said tubes in an upright position, said stand including:

a backing member having an upper end and a lower end;

an elongated base having a top surface, and a front surface, said base extending forwardly of the lower end of said backing member, said top surface having a plurality of cylindrical recesses each adapted to loosely receive the lower end of one of said tubes and a groove associated with each cylindrical recess, each groove extending from its associated recess to said front surface and being of lesser depth than its associated recess;

an elongated head member extending along a side of said backing member about midway thereon parallel to said base member and spaced therefrom, said head member having a front surface, a bottom surface and an upper surface, a plurality of cylindrical recesses in said bottom surface axially aligned with the cylindrical recesses in said base for telescopingly receiving the upper ends of said tubes and narrow slot means in said upper surface communicating with said recesses in said head member for feeding coins to said tubes via said recesses, said slot means being of a width slightly greater than the coins to be stored.

* * * * *